US006750641B1

(12) United States Patent
Ivanov et al.

(10) Patent No.: US 6,750,641 B1
(45) Date of Patent: Jun. 15, 2004

(54) METHOD AND CIRCUIT FOR TEMPERATURE NONLINEARITY COMPENSATION AND TRIMMING OF A VOLTAGE REFERENCE

(75) Inventors: Vadim V. Ivanov, Tucson, AZ (US); Igor M. Filanovsky, Edmonton (CA)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/456,043

(22) Filed: Jun. 5, 2003

(51) Int. Cl.[7] ..... G05F 3/16
(52) U.S. Cl. ..... 323/315
(58) Field of Search ..... 323/313, 314, 323/315, 907, 316, 317

(56) References Cited

U.S. PATENT DOCUMENTS

| | | | | |
|---|---|---|---|---|
| 4,603,291 A | * | 7/1986 | Nelson | 323/315 |
| 4,789,819 A | * | 12/1988 | Nelson | 323/314 |
| 5,291,122 A | | 3/1994 | Audy | |
| 5,391,980 A | | 2/1995 | Thiel et al. | |
| 6,218,822 B1 | | 4/2001 | MacQuigg | |

* cited by examiner

*Primary Examiner*—Shawn Riley
(74) *Attorney, Agent, or Firm*—W. Daniel Swayze, Jr.; W. James Brady; Frederick J. Telecky, Jr.

(57) ABSTRACT

An exemplary method and circuit for temperature nonlinearity compensation and trimming of a voltage reference are configured to provide for two-point independent trimming of each of the curvature coefficients within the Taylor approximation curve. A voltage reference circuit is configured with a translinear circuit having an input current source. The translinear circuit comprises a translinear unit having a plurality of output currents corresponding to the curvature coefficients of the Taylor row approximation curve, with the output currents coupled to a control input terminal of the voltage reference. During trimming, at a first nominal temperature, the input current source is trimmed to a zero value, and each of the curvature terms of the Taylor approximation will be equal to zero value. At a second temperature the plurality of output currents of the translinear circuit can be measured to enable independent trimming of each of the curvature coefficients such that the output currents of the translinear circuit are made substantially equal to predetermined values. Thus, each of the coefficients of the Taylor approximation curve are independently trimmed to pass through zero at the first temperature and through the predetermined values at the second temperature without regard from one voltage reference circuit to another.

19 Claims, 2 Drawing Sheets

METHOD AND CIRCUIT FOR TEMPERATURE NONLINEARITY COMPENSATION AND TRIMMING OF A VOLTAGE REFERENCE

FIELD OF THE INVENTION

The present invention relates voltage reference circuits, and more particularly to a method and circuit for providing temperature nonlinearity compensation and trimming in voltage reference circuits.

BACKGROUND OF THE INVENTION

Many integrated circuits require a stable reference voltage for operation. Improved stability in voltage references is being demanded for use in data acquisition systems, voltage regulators, measurement devices, analog-to-digital converters and digital-to-analog converters, to name a few. Voltage references being utilized can include Zener-based references such as buried-Zener references, or bandgap references, which can operate with a lower supply voltage, dissipate less power and provide longer-term stability than that of buried-Zener references.

Ideally, a voltage reference should provide a constant voltage regardless of the circuit temperature or its loading conditions. Buried-Zener references are not available on the most of the modem processes, so bandgap references are most often used when more temperature stability is required. However, any voltage reference has a certain amount of temperature dependence, i.e., the output changes nonlinearly with temperature.

The cause of such nonlinearity is mainly due to non-ideal characteristics of all the reference components. For band gap references the large portion of the nonlinearity is defined by the bow-like non-linearity of the base-emitter voltage ($V_{be}$) of a bipolar transistor with respect to temperature. Generally, any of the nonlinearity characteristics of voltage references can be approximated by a Taylor Row expression, such as $Y=a_2T^2+a_3T^3+\ldots a_nT^n$, where accuracy of the approximation improves with the increasing number of terms.

Many circuits have attempted to implement logarithmic correction of the bandgap reference output voltage, commonly referred to as "curvature correction" in such circuits. One more well-known and long-used circuit is the "Brokaw Cell" as is illustrated in FIG. 1. However, the Brokaw curvature correction technique is only a second-order ($T^2$) correction, whereas real bandgap circuits have a significant amount of higher-order curvature.

Over the last ten years or more, circuits have been developed in an attempt to provide second and third-order approximation of the bandgap curvature. Such circuits have used, for example, temperature-dependent resistors in a Brokaw cell or other similarly modified structures. While such circuits use nonlinear temperature dependence of current or resistance to control the input of the voltage reference, such circuits have become significantly more complicated and costly in order to generate higher order correction terms, and have generally relied on process matching and component stability for permanence on the approximated curves. Since real voltage references deviate significantly from the theoretic Tln(T) characteristic of an ideal bandgap reference, the matching and component selection process can be expensive. Moreover, packaging processes cause additional shifts in both the output voltage and temperature drift, while trimming of the voltage reference circuits after packaging has not yet been implemented.

SUMMARY OF THE INVENTION

In accordance with various aspects of the present invention, a method and circuit for temperature nonlinearity compensation and trimming of a voltage reference are configured to provide for two-point independent trimming of each of the curvature coefficients within the Taylor approximation curve.

In accordance with an exemplary embodiment of the present invention, a voltage reference circuit is configured with a translinear circuit having an input current source. The voltage reference circuit comprises a voltage reference having a control input terminal for receiving an output signal control signal and an output terminal for providing an output reference signal. The translinear circuit comprises a translinear unit having a plurality of output currents corresponding to the curvature coefficients of the Taylor row approximation curve, with the output currents coupled to the control input terminal of the voltage reference. The input current source is configured with the translinear unit to be trimmable to a zero value at a nominal temperature.

During trimming of the voltage reference, at a first nominal temperature, the input current source is trimmed to a zero value, and each of the curvature terms of the Taylor approximation will be equal to zero value at the first temperature. At a second temperature the plurality of output currents of the translinear circuit can be measured to enable independent trimming of each of the curvature coefficients such that the output currents of the translinear circuit are made substantially equal to predetermined values. Thus, each of the coefficients of the Taylor approximation curve are independently trimmed to pass through zero at the first temperature and through the predetermined values at the second temperature without regard from one voltage reference circuit to another. As a result, the approximation curve as a whole does not change from one circuit to another as long as the translinear circuit has a stable input/output function. Further, independently trimming for at least two points for each curvature coefficient make the Taylor approximation curve repeatable.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION OF EXEMPLARY EMBODIMENTS OF THE INVENTION

The present invention may be described herein in terms of various functional components and various processing steps. It should be appreciated that such functional components may be realized by any number of hardware or structural components configured to perform the specified functions. For example, the present invention may employ various integrated components, e.g., buffers, voltage and current references, current mirrors, or amplifier components and the like, comprised of various electrical devices, e.g., resistors, transistors, capacitors, diodes or other devices, whose values may be suitably configured for various intended purposes. In addition, the exemplary methods and circuits may be practiced in any integrated circuit application, such as in data acquisition systems, voltage regulators, measurement devices, analog-to-digital converters and digital-to-analog converters, instrumentation amplifiers, and other like devices. However for purposes of illustration only, exemplary embodiments of the present invention are described herein in connection with the trimming of a voltage reference circuit.

Further, it should be noted that while various components may be suitably coupled or connected to other components within exemplary circuits, such connections and couplings can be realized by direct connection between components, or by connection through other components and devices located therebetween. To understand the various operational sequences of the present invention, an exemplary description is provided. However, it should be understood that the following example is for illustration purposes only and that the present invention is not limited to the embodiments disclosed.

As discussed above, while conventional curvature compensation circuits have been developed in an attempt to provide second and third-order approximation of the bandgap curvature, e.g., by using nonlinear temperature dependence of current or resistance to control the input of the voltage reference, such circuits have become significantly more complicated and costly in order to generate higher order correction terms, and have generally relied on process matching and component stability for permanence on the approximated curves. More importantly, none of the conventional curvature compensation circuits utilize at least two-point independent trimming of the curvature coefficients.

However, in accordance with various aspects of the present invention, a method and circuit for temperature nonlinearity compensation and trimming of a voltage reference are configured to provide for at least two-point independent trimming of each of the curvature coefficients within the Taylor approximation curve.

Figure 1:
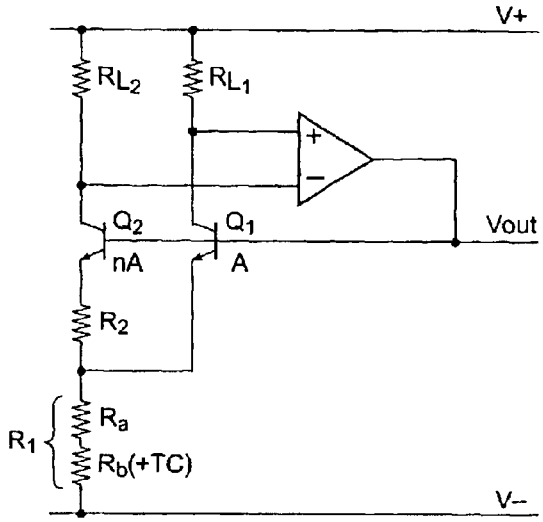
FIG. 1 (PRIOR ART)
FIG. 1 illustrates a circuit diagram of prior-art bandgap reference incorporating curvature compensation.
Figure 2:
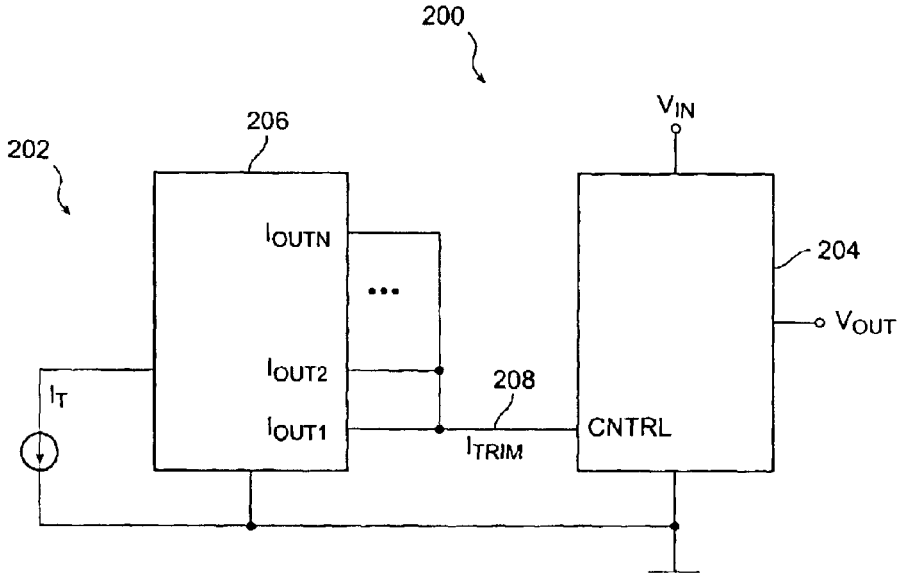
FIG. 2 illustrates a block diagram of a voltage reference circuit configured with an exemplary temperature nonlinearity compensation and trimming circuit in accordance with an exemplary embodiment of the present invention.

In accordance with an exemplary embodiment of the present invention, with reference to FIG. 2, a voltage reference circuit 200 configured for temperature nonlinearity compensation and trimming comprises a voltage reference 204 coupled with a translinear circuit 202. Voltage reference 204 comprises a control input terminal CNTRL for receiving an output control signal 206, an input terminal $V_{IN}$ for receiving an input reference signal, and an output terminal $V_{OUT}$ for providing an output reference signal. Voltage reference 204 can comprise any type of voltage reference, including Zener-based or bandgap references.

Translinear circuit 202 comprises a translinear unit 206 and a current source $I_T$. Translinear unit 206 and current source IT are configured to provide for independent trimming of each of the curvature coefficients for at least two points on the approximation curve. Translinear unit 206 includes a plurality of output currents corresponding to two or more curvature coefficients of the Taylor row approximation curve. For example, translinear unit 206 can comprise output currents $I_{OUT1}$, $I_{OUT2}$ . . . and $I_{OUTN}$ that correspond to curvature terms $A_2T^2$, $A_3T^3$, . . . and $A_{n+1}$, respectively, of the Taylor row approximation curve. Plurality of output currents $I_{OUT1}$, $I_{OUT2}$ . . . and $I_{OUTN}$ are coupled together to provide output control signal 208, i.e., trim current $I_{TRIM}$, that is coupled to control input terminal CNTRL of voltage reference 202. Translinear unit 206 can be configured in various manners for providing control of the curvature compensation terms.

Current source $I_T$ is configured with translinear unit 206 to be trimmable to a zero value at a first temperature, such as a nominal temperature, e.g., room temperature. In accordance with an exemplary embodiment, comprises a linearly temperature-dependent current source, e.g., a proportional-to-absolute-temperature current $I_{PTAT}$. Current source $I_T$ can comprise numerous current-source configurations for generation of temperature-dependent current signals.

Figure 4:
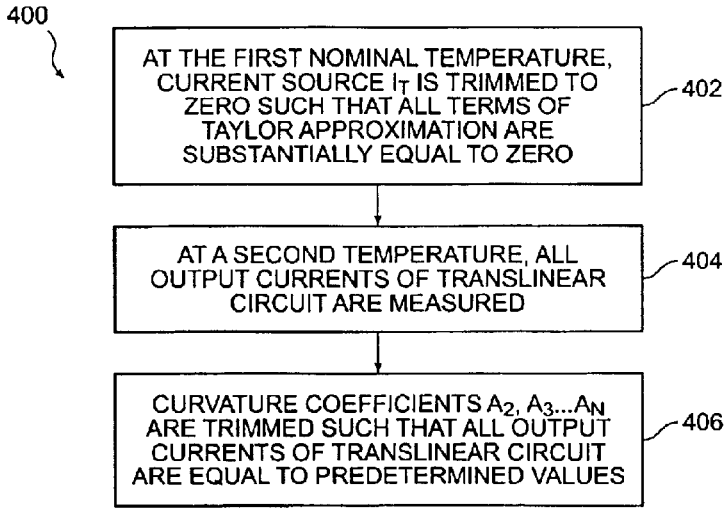
FIG. 4 illustrates a block diagram of an exemplary trimming method in accordance with an exemplary embodiment of the present invention.

With reference to FIG. 4, an exemplary method of trimming of the voltage reference using translinear circuit 202 is illustrated. In a step 402, at a first nominal temperature, current source $I_T$ is trimmed to a zero value. As a result, all of the curvature terms $A_2T^2$, $A_3T^3$, . . . and $A_{n+1}T^{n+1}$, of the Taylor approximation will also have a zero value at the first temperature. In a step 404, at a second temperature, the plurality of output currents $I_{OUT1}$, $I_{OUT2}$ . . . and $I_{OUTN}$ of translinear unit 206 can be measured. Upon measurement, in a step 406, curvature coefficients $A_2$, $A_3$, . . . and $A_n$ can be trimmed such that output currents $I_{OUT1}$, $I_{OUT2}$ . . . and $I_{OUTN}$ of translinear unit 206 are made substantially equal to predetermined values. The predetermined values can be selected by iterative measurements, trimming of a pilot or test production lot or assortment, or other like techniques. While the second temperature can be suitably selected from within a range of temperatures, to improve accuracy the second temperature can be suitably selected to a temperature close to the output parameter of the operating range of the voltage reference, such as approximately 85° C. or 125° C.

Accordingly, each of curvature coefficients $A_2$, $A_3$, . . . and $A_n$, of the Taylor approximation curve can be independently trimmed to pass through at least two points on the approximation curve, such as zero at the first nominal temperature and through the predetermined values at the second temperature without regard from one voltage reference circuit to another. As a result, the Taylor approximation curve as a whole does not change from one circuit to another as long as translinear circuit 202 is configured with a stable input/output function. Further, independently trimming for at least two points on the approximation curve for each curvature coefficient $A_2$, $A_3$, . . . and $A_n$ makes the Taylor approximation curve repeatable.

Figure 3:
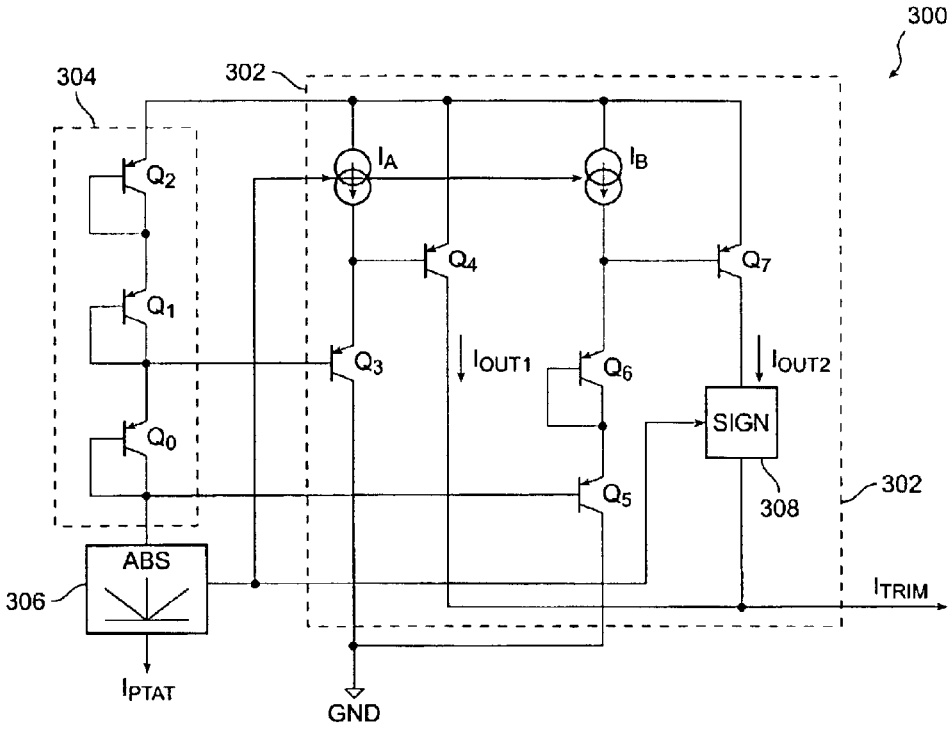
FIG. 3 illustrates a circuit diagram of exemplary translinear circuit in accordance with an exemplary embodiment of the present invention.

For more efficient operation, translinear circuit 202 is configured to provide for zero output with zero input current, i.e., when current source $I_T$ is zero. Translinear circuit 202 can be configured in various manners, including both CMOS and bipolar configurations. With reference to FIG. 3, in accordance with an exemplary embodiment, a translinear circuit 300 is configured to provide a trim current $I_{TRIM}$ for control of the voltage reference, such as voltage reference 204. Translinear circuit 300 suitably comprises a translinear unit 302 and an input current source 304 configured to provide a trim current $I_{TRIM}$. In accordance with this exemplary embodiment, translinear circuit 300 is configured such that:

$$I_{TRIM}=(I_T^2/I_A)+(I_T^3/I_B^2)$$

and guarantees that $I_{CC}=0$ when $I_T=0$.

Input current source 304 comprises a plurality of diodes connected in series, such as diode-connected transistor devices $Q_0$, $Q_1$ and $Q_2$, configured to provide a linearly temperature-dependent current source. Input current source 304 is realized as current source $I_T$ that may comprise, for example, a current proportional to absolute temperature, i.e., $I_{PTAT}$. Input current source 304 can also be trimmed to a zero value at the first temperature, e.g., a nominal temperature. Input current source 304 can comprise any number of diode devices, or any other circuit configuration, for providing an input current signal $I_T$.

Translinear unit 302 is configured for at least third-order approximation of the curvature coefficients, and suitably comprises a pair of current sources, $I_A$ and $I_B$, and a pair of output transistors, $Q_4$ and $Q_7$. Translinear unit 302 is configured to provide for collector current $I_{CC}=0$ when input current signal $I_T=0$. Current source $I_A$ is configured for control of transfer coefficient $A_2$, while current source $I_B$ is configured for control of transfer coefficient $A_3$. Current sources $I_A$ and $I_B$ can comprise any current source configuration. Current source $I_A$ is coupled to input current source 304 through an emitter of a transistor $Q_3$, e.g., a collector-base junction of transistor $Q_1$ is coupled to the base of transistor $Q_3$, while current source $I_B$ is coupled to input current source 304 through a diode-connected transistor $Q_6$ in series with an emitter of a transistor $Q_5$, e.g., a collector-base junction of transistor $Q_0$ is coupled to the base of transistor $Q_5$. Current sources $I_A$ and $I_B$ are also coupled to ground through collectors of transistors $Q_3$ and $Q_5$.

Output transistors $Q_4$ and $Q_7$ are configured for providing output currents $I_{OUT1}$ and $I_{OUT2}$, respectively, with output current $I_{OUT1}$ corresponding to the $T^2$ term, and output current $I_{OUT2}$ corresponding to the $T^3$ term. Output transistor $Q_4$ has a base terminal coupled to current source $I_A$, thus generating curvature term $A_2T^2$, while output transistor $Q_7$ has a base terminal coupled to current source $I_A$, thus generating curvature term $A_3T^3$. Output currents $I_{OUT1}$ and $I_{OUT2}$ are summed together to provide a trim current $I_{TRIM}$ for control of the voltage reference, with trim current $I_{TRIM}$ being equal to $(I_T^2/I_A)+(I_T^3/I_B^2)$.

While translinear unit 302 is illustrated to provide two curvature terms, $A_2T^2$ and $A_3T^3$, translinear unit 302 can also provide more than two curvature terms up to $A_nT^n$. For example, translinear unit 302 can be configured with one or more additional current sources $I_C$, $I_D$, . . . $I_N$, and one or more additional output transistors for providing one or more output currents $I_{OUT3}$, $I_{OUT4}$, . . . $I_{OUTN}$ corresponding to one or more additional curvature terms $T_4$, $T^5$, . . . $T^N$. Further, translinear unit 302 can comprise various other circuit configurations, in both CMOS or bipolar technology, for providing curvature terms, $A_nT^n$.

To facilitate operation below nominal temperature, translinear circuit 300 can also be configured with an absolute value circuit 306 and a sign switch 308. Absolute value circuit 306 is coupled to input current source 304 through at least one of the diodes, e.g., diode-connected transistor $Q_0$, and is coupled to current sources $I_A$ and $I_B$. Absolute value circuit 306 can comprise any circuit configuration for determining an absolute value of the input signal $I_{PTAT}$. Moreover, absolute value circuit 306 can be suitably replaced by a 4-quadrant multiplier circuit, or input current source 304 could be suitably mirrored around to the output devices through current mirror circuits. Sign switch 308 is coupled to absolute value circuit 306 for sensing when the input signal $I_{PTAT}$ is negative. Sign switch 308 is configured between output transistor $Q_7$ and trim current $I_{TRIM}$ for providing a switching of the polarity signal of the $T^3$ output signal, i.e., $I_{OUT2}$, when the input signal $I_{PTAT}$ is negative, i.e., below nominal temperature. Sign switch 308 can comprise any circuit configuration for providing a sign switching function of the $T^3$ output signal.

In summary, a method and circuit for temperature nonlinearity compensation and trimming of a voltage reference are configured to provide for two-point independent trimming of each of the curvature coefficients within the Taylor approximation curve. As a result, the Taylor approximation curve as a whole does not change from one circuit to another as long as translinear circuit 202 is configured with a stable input/output function. Further, independently trimming for at least two points on the approximation curve for each curvature coefficient $A_2$, $A_3$, . . . and $A_n$ makes the Taylor approximation curve repeatable.

The present invention has been described above with reference to exemplary embodiments. However, those skilled in the art will recognize that changes and modifications may be made to the exemplary embodiment without departing from the scope of the present invention. For example, the various components may be implemented in alternate ways, such as varying or alternating the steps in different orders. Further, various procedures and techniques for trimming can be implemented, such as laser etching of components, or any other trimming procedure. These alternatives can be suitably selected depending upon the particular application or in consideration of any number of factors associated with the operation of the system. For example, These and other changes or modifications are intended to be included within the scope of the present invention.

What is claimed is:

1. A voltage reference circuit for providing a voltage reference signal, said voltage reference circuit comprising:

a voltage reference having a control input terminal and an output terminal for providing an output reference signal;

a temperature-dependent current source configured for providing an input current signal; and a translinear circuit coupled to said temperature-dependent current source and said voltage reference, said translinear circuit having a plurality of output currents corresponding to at least two curvature coefficients of a Taylor approximation curve, said output currents summed to provide a trim current signal to said control input terminal, and wherein said translinear circuit and said temperature-dependent current source are configured to provide for at least two-point independent trimming of each of said at least two curvature coefficients of a Taylor approximation curve.

2. The voltage reference circuit according to claim 1, wherein said translinear circuit and said temperature-dependent current source are configured to provide for at least two-point independent trimming through trimming of each of said at least two curvature coefficients to zero at a first temperature, and trimming each of said at least two curvature coefficients to predetermined values at a second temperature.

3. The voltage reference circuit according to claim 1, wherein said translinear circuit comprises at least two current sources, each of said at least two current source configured for control of a transfer coefficient, and a pair of output transistors, each of said output transistors corresponding to a curvature term.

4. The voltage reference circuit according to claim 1, wherein said temperature-dependent current source is linear and configured to provide a proportional-to-absolute-temperature current.

5. The voltage reference circuit according to claim 1, wherein said translinear circuit comprises a first current source for controlling a first curvature coefficient and a second current source for controlling a second curvature coefficient, a first output transistor and a second output transistor, said first current source and said first output transistor corresponding to a first curvature term and said second current source and said second output transistor corresponding to a second curvature term.

6. The voltage reference circuit according to claim 5, wherein said translinear circuit further comprises an absolute value circuit coupled to said temperature-dependent current source and a sign switch coupled to said second output transistor, said sign switch configured for sensing when said input current signal is negative.

7. A translinear circuit for providing temperature nonlinearity compensation and trimming in a voltage reference, said translinear circuit comprising:

a temperature-dependent current source configured for providing an input current signal; and a translinear unit coupled to said input current signal of said temperature-dependent current source, said translinear unit having a plurality of output currents corresponding to at least two curvature coefficients of a Taylor approximation curve, said plurality of output currents summed to provide a trim current signal to the voltage reference; and wherein said translinear circuit and said temperature-dependent current source are configured to provide for at least two-point independent trimming of each of said at least two curvature coefficients of a Taylor approximation curve.

8. The translinear unit according to claim 7, wherein said wherein said translinear unit and said temperature-dependent current source are configured to provide for at least two-point independent trimming through trimming of each of said at least two curvature coefficients to zero at a first temperature, and trimming each of said at least two curvature coefficients to predetermined values at a second temperature.

9. The translinear circuit according to claim 1, wherein said translinear unit comprises at least two current sources, each of said at least two current source configured for control of a transfer coefficient, and a pair of output transistors, each of said output transistors corresponding to a curvature term.

10. A integrated circuit comprising a voltage reference circuit for providing a voltage reference signal, said voltage reference circuit comprising:

a voltage reference having a control input terminal and an output terminal for providing an output reference signal;

a temperature-dependent current source configured for providing an input current signal; and a translinear circuit coupled to said input current signal, said translinear circuit having at least two output currents, each of said at least two output currents corresponding to an $A_nT^n$ curvature coefficient of a Taylor approximation curve, said at least two output currents summed together to provide a trim current signal to said control input terminal, and said translinear circuit and said temperature-dependent current source are configured to provide for at least two-point independent trimming of each of said corresponding $A_nT^n$ curvature coefficients.

11. The integrated circuit according to claim 10, wherein said translinear circuit and said temperature-dependent current source are configured to provide for at least two-point independent trimming through trimming of each of said corresponding $A_nT^n$ curvature coefficients to zero at a first temperature, and trimming each of said corresponding $A_nT^n$ curvature coefficients to predetermined values at a second temperature.

12. The integrated circuit according to claim 10, wherein said translinear circuit comprises a first current source for controlling a first curvature coefficient and a second current source for controlling a second curvature coefficient, a first output transistor and a second output transistor, said first current source and said first output transistor corresponding to a first curvature term and said second current source and said second output transistor corresponding to a second curvature term.

13. The integrated circuit according to claim 10, wherein said translinear circuit is configured to provide a zero output when said input current signal has a zero value.

14. A method for trimming a voltage reference to compensate for temperature nonlinearity, said method comprising the steps of:

at a first nominal temperature, trimming an input current source to a zero value such that curvature coefficients of a Taylor approximation corresponding to a plurality of output currents of a translinear unit will be equal to zero value at the first temperature; and at a second temperature, measuring the plurality of output currents of the translinear circuit; and at said second temperature, independently trimming of each of the curvature coefficients such that the plurality of output currents of the translinear circuit are made substantially equal to predetermined values.

15. The method according to claim 14, wherein said step of independently trimming comprises trimming at a least two points for each of the curvature coefficients.

16. The method according to claim 15, wherein said step of independently trimming comprises controlling a first curvature term corresponding from a first current source and a first output transistor, and a second curvature term corresponding from a second current source and a second output transistor.

17. A voltage reference circuit for providing a voltage reference signal, said voltage reference circuit comprising:

a voltage reference; and a translinear circuit coupled to said voltage reference, said translinear circuit having a plurality of output currents corresponding to at least two curvature coefficients of a Taylor approximation curve, said output currents summed to provide a trim current signal to said voltage reference.

18. The voltage reference circuit according to claim 17, said voltage reference circuit further comprising a temperature-dependent current source configured for providing an input current signal, said temperature-dependent current source coupled to said translinear circuit.

19. The voltage reference circuit according to claim 18, wherein said translinear circuit and said temperature-dependent current source are configured to provide for at least two-point independent trimming of each of said at least two curvature coefficients of a Taylor approximation curve.

* * * * *

UNITED STATES PATENT AND TRADEMARK OFFICE

CERTIFICATE OF CORRECTION

PATENT NO. : 6,750,641 B2 
DATED : June 15, 2004
INVENTOR(S) : Vadim V. Ivanov, Igor M. Filanovsky and Sergey V. Alenin It is certified that error appears in the above-identified patent and that said Letters Patent is hereby corrected as shown below:

Title page,
Item [75], Inventors, please change as follows:
-- [75] Inventors: Vadim V. Ivanov, Tucson, AZ (US); Igor M. Filanovsky, Edmonton (CA); Sergey V. Alenin, Tucson, AZ (Russia) --

Signed and Sealed this

Twenty-third Day of November, 2004

JON W. DUDAS
*Director of the United States Patent and Trademark Office*